United States Patent [19]

Chong

[11] Patent Number: 4,525,877

[45] Date of Patent: Jul. 2, 1985

[54] SPORTS GLOVE

[75] Inventor: Hae C. Chong, Seoul, Rep. of Korea

[73] Assignee: Franklin Sports Industries, Inc., Stoughton, Mass.

[21] Appl. No.: 552,253

[22] Filed: Nov. 16, 1983

[51] Int. Cl.[3] ..... A41D 19/00

[52] U.S. Cl. ..... 2/161 A; 2/163; 2/168

[58] Field of Search ..... 2/161 A, 16, 159, 163, 2/161 R, 162, 20

[56] References Cited

U.S. PATENT DOCUMENTS

| | | | |
|---|---|---|---|
| D. 232,670 | 9/1974 | Long . | |
| D. 240,171 | 6/1976 | Giambazi . | |
| 1,205,229 | 11/1916 | Linden | 2/161 R |
| 1,673,517 | 6/1928 | Kurz | 2/161 R |
| 1,900,395 | 3/1933 | Gitt, 2d . | |
| 1,922,095 | 8/1933 | Jones | 2/159 |
| 2,101,763 | 12/1937 | Sturm, Sr. | 2/161 R |
| 2,559,788 | 7/1951 | Patterson, Jr. | 2/162 |
| 2,582,240 | 1/1952 | Dumas | 2/161 R |
| 2,590,015 | 3/1952 | Kennedy | 2/162 |
| 2,596,349 | 5/1952 | Thurlow et al. | 2/169 |
| 2,736,034 | 2/1956 | Frebenhagen | 2/161 R |
| 2,907,046 | 10/1959 | Scherr | 2/161 R |
| 3,152,338 | 10/1964 | Strauss | 2/163 |
| 3,274,616 | 9/1966 | Russo | 2/161 |
| 3,430,265 | 3/1969 | Mazza | 2/162 |
| 3,504,379 | 4/1970 | Glick | 2/161 |
| 3,512,776 | 5/1970 | Thomas, Sr. | 273/54 |
| 3,588,917 | 6/1971 | Antonious | 2/161 |
| 3,952,333 | 4/1976 | Fujita | 2/161 |
| 4,040,126 | 8/1977 | Cecil | 2/161 |
| 4,051,552 | 10/1977 | Widdemer | 2/161 A |
| 4,183,098 | 1/1980 | Knowles, Jr. | 2/161 |
| 4,388,733 | 6/1983 | Anstett | 2/161 |
| 4,408,358 | 10/1983 | Swan | 2/161 A |

*Primary Examiner*—Werner H. Schroeder
*Assistant Examiner*—T. G. Graveline
*Attorney, Agent, or Firm*—Kenway & Jenney

[57] ABSTRACT

Disclosed is an improved sports glove, for use in a game such as racquetball, having a front portion comprised of a strong, substantially inextensible material such as leather, and a rear portion made from a perspiration absorbing material, such as terry cloth. The glove also includes an integral wrist portion which is made of the same perspiration absorbing material as the rear portion, and attached to this wrist portion is a wrist support band which is wrapped around the wrist and secured by a piece of Velcro. Reinforcing pads may be placed on the front portion of the glove in positions particularly susceptible to wear. A very smooth elastic material may also be inserted between the front and rear portions of the fingers so as to provide the fingers with greater freedom of movement. This very smooth elastic material should be of a size smaller than the rear finger portions and larger than the front finger portions so as to impart a natural curvature to the glove fingers.

8 Claims, 3 Drawing Figures

SPORTS GLOVE

BACKROUND OF THE INVENTION

The present invention relates to gloves and more particularly to a sports glove for use in sports such as racquetball or tennis.

When playing sports which require the player to grip a racquet, club or bat, the player will often need to wear a glove. Such gloves offer a number of advantages. First of all, a glove will prevent blisters from forming on the player's hand. Blisters, which commonly occur from the rubbing of the club against the skin when the player does not have a tight grip on the handle, will often either impede the player's performance or prevent him from continuing play. In addition to preventing blisters, a glove will also assure a firm grip. Very frequently a person engaged in a sport in which a good grip is required will have perspiration on his hands. When the player tries to grip any object with perspiration on his hands, the object will often slip and the player will either hit a poor shot or have the racquet or club fly out of his hand.

A number of problems have been encountered with sports gloves currently on the market, and most of these problems center around the fact that the useful life of a sports glove is not very long. One reason for the short life span of sports gloves is that when a glove is used in a game such as racquetball, the glove absorbs a considerable amount of perspiration, and when the glove becomes wet with perspiration, the leather tends to rip more easily. In addition, after a glove, that has become wet with perspiration, dries, the leather tends to harden and on subsequent uses the glove will often develop cracks. A number of prior art gloves attempt to deal with this problem by providing perforations in the leather for ventilation. While such perforations may reduce the amount of perspiration slightly, the glove will still become wet. In addition, when a glove does rip, the perforations cause the leather to offer reduced resistance to such tearing. Finally, since leather is a substantially inextensible material, it does not give as much as a soft fabric would. Therefore, even if tears and cracks do not develop, there will be a number of stress points in the leather as well as stretch marks which will cause the glove to lose its original shape.

Also contributing to the short life span of a sports glove, is the fact that some portion of the glove will wear out before other portions. The reason for the uneven wear is that some portions of the glove surface are more susceptible to abrasion between the racquet handle and the glove than are other portions. U.S. Pat. No. 3,588,917 shows an attempt to deal with such uneven wear by sewing reinforcing pads over the front surface of the glove. Such reinforcing pads, however, cause the glove to be rather bulky, and, as a result, a certain amount of "feel" for the racquet is sacrificed.

Another problem associated with sports gloves is that they will not always fit securely around the hand, especially after use of the glove has caused the glove to stretch. When the glove is not tightly secured on the hand there is a danger that the glove will fall off the hand thereby possibly causing the player to lose control of the racquet. Originally, this problem was solved by having straps attached to the glove in such a way that they could be tightened so as to secure the glove on the hand. Examples of such straps are shown in U.S. Pat. Nos. 1,900,395; 1,922,095 and 2,559,788. The straps, however, would often loosen, and a need arose for more efficient securing means. As a result, many gloves were designed to include Velcro fasteners as shown in U.S. Pat. Nos. 3,430,265; 3,588,917 and 4,040,126. All of these patents, however, show the Velcro fastener on the back of the glove which causes the glove to be tightened around the center of the hand. This type of fit causes discomfort to the player since the movement of his hand is restricted. A better approach would be to secure the glove around the wrist as shown in U.S. Pat. No. 3,274,616 so that movement of the hand is never restricted. The problem with the securing means of U.S. Pat. No. 3,274,616 is that it is not attached to the glove, and as a result, it could easily slip off the glove.

Therefore, it is a principal object of the present invention to provide an improved sports glove for use in games such as racquetball or tennis.

A further object of the present invention is to provide an improved sports glove which will provide a comfortable fit and have a long life.

Still another object of the present invention is to provide an improved sports glove which will obviate the need for separate sweat bands or wrist supports.

SUMMARY OF THE INVENTION

The improved sports glove of the present invention includes a front portion made from a strong, substantially inelastic material such as leather. This front portion may include reinforcing patches in spots subject to the most abrasion from the handle of a racquet. The back of this improved sports glove is made of a perspiration absorbing material, such as terry cloth which aids in the absorption of perspiration. This glove fits over a user's hand and down over his wrist, and the perspiration absorbing material also extends around the wrist portion of the glove. Attached to the wrist portion of the glove is an elastic wrist support which is stretched around the wrist and secured by a Velcro fastener. A smooth elastic material may also be utilized to provide a bridge between the front and rear portions of the fingers in order to provide more freedom of movement for the fingers. In addition, when the elastic material between the front and rear finger portions is of a size smaller than the rear finger portion and larger than the front finger portion, the fingers of the glove will possess a natural curvature corresponding to the natural curvature of a person's fingers.

These and other features and objects will become apparent to those skilled in the art in the following detailed description which should be read in light of the accompanying drawings.

DETAILED DESCRIPTION OF THE DETAILED EMBODIMENT

Figure 1:
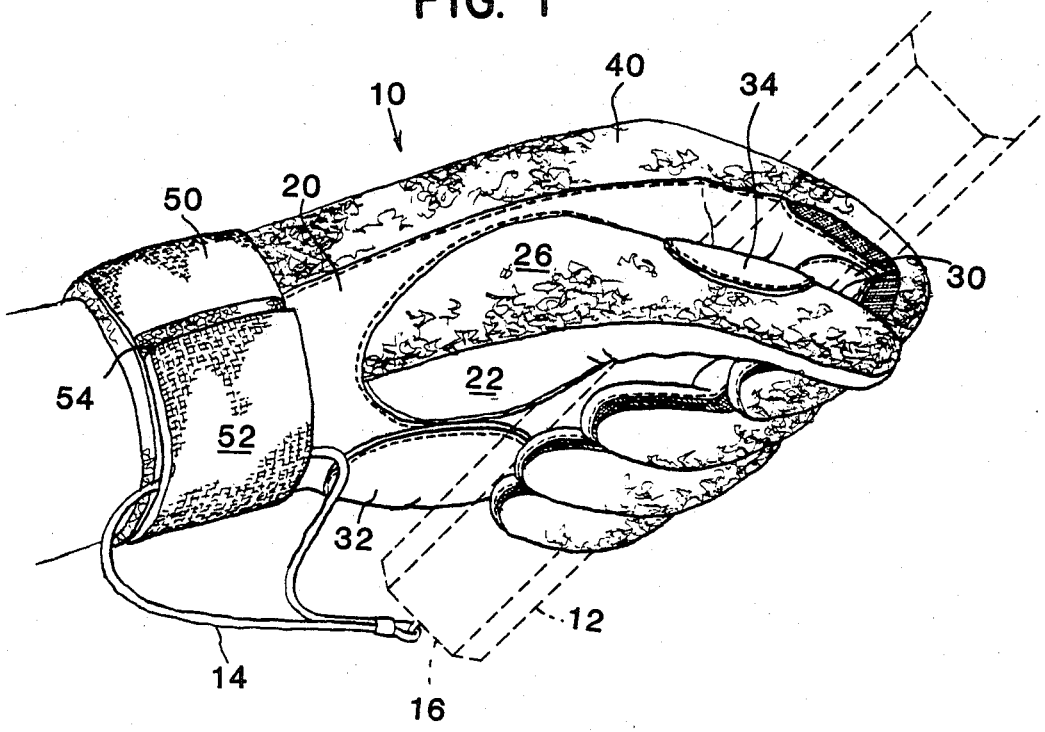
FIG. 1 is a view in perspective of the sports glove of a present invention gripping a handle of a racquet which is shown in phantom.

The sports glove 10 of the present invention is shown in FIG. 1 gripping a handle of a racquet 12 which is shown in phantom. The racquet 12 includes a strap 14 which is connected to the base 16 of the handle of the racquet 12. The glove 10 includes a front portion 20, a rear portion 40 and a wrist portion 50.

Figure 2:
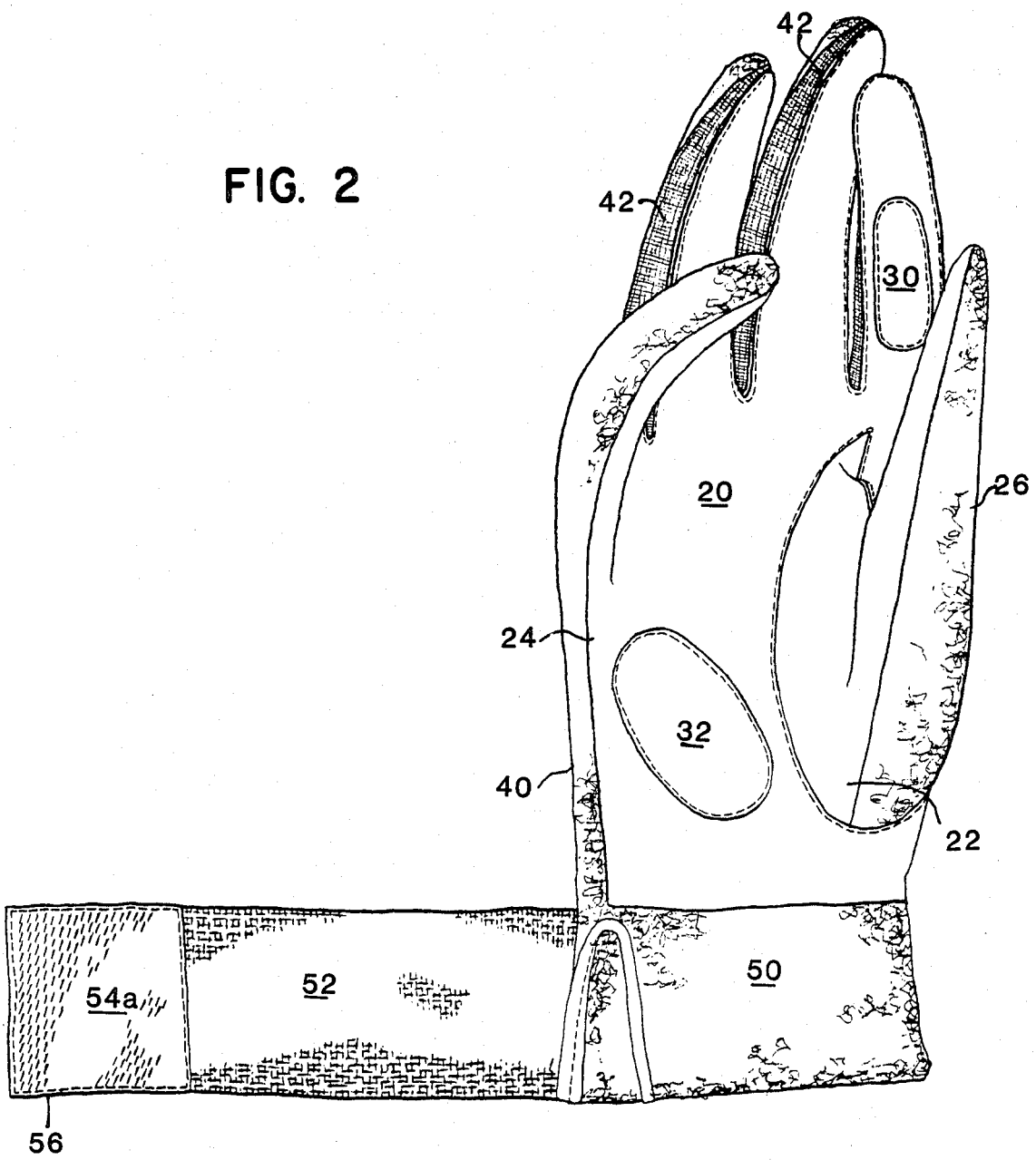
FIG. 2 is a front perspective view of the sports glove of FIG. 1 shown fully extended.

The front surface 20 of the glove 12, as shown in FIG. 2, is made of a strong, inelastic material, such as leather. The leather will cover the portion of the glove which extends from the front of all five fingers and along the entire front surface of the hand terminating at the base of the palm. The front covering 20 of the glove 10 is a two-part construction with one part 22 covering the front, inside portion of the thumb and the other part 24 covering the remainder of the front of the hand including the other four fingers.

Figure 3:
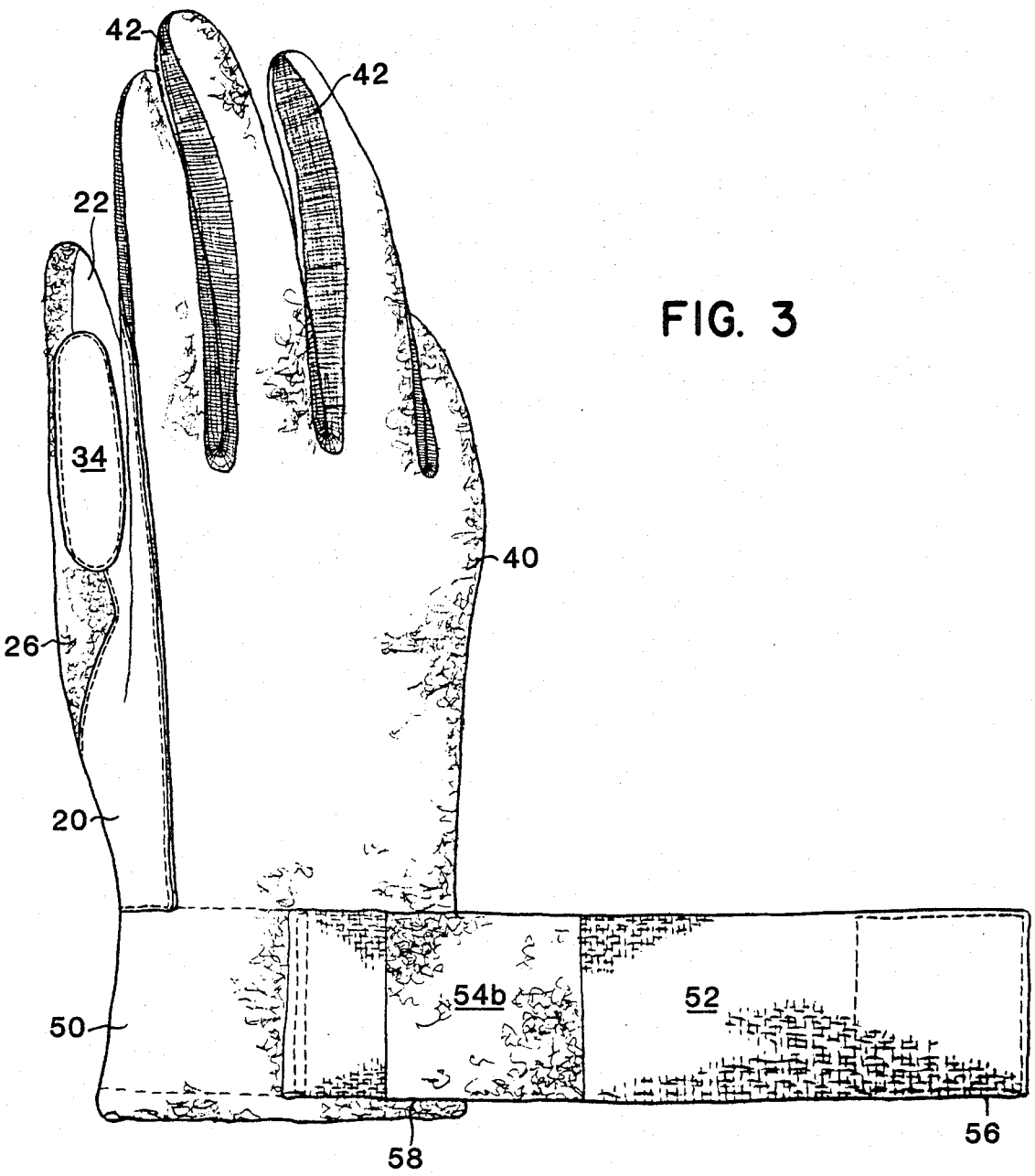
FIG. 3 is a rear perspective view of the sports glove of FIG. 1 shown fully extended.

In addition to the leather covering the front portion 20 of the glove 10, additional pieces of the same or a similar strong, inelastic material are sewn onto the front portion 20 of the glove in order to provide reinforcement for portions of the glove which are particularly susceptible to wear. Two of these portions, 30 and 32 are shown in FIG. 2. The reinforcing pad 30 provides reinforcing protection to the index finger and pad 32 provides protection against wearing to the palm portion of the glove. The third reinforcing pad 34 is best seen in FIG. 3. This pad 34 is applied on the inside of the thumb portion of the glove, and it overlaps both the leather portion of the thumb 22 and the backing portion of the thumb 26.

The rear portion 40 of the glove 10 is best seen in FIG. 3, and is made of a perspiration absorbing material, such as terry cloth. This rear portion 40 extends from the back portions of the fingers down the back of the hand and over the wrist. In addition, the perspiration absorbing material extends entirely around the wrist portion 50 of the glove so that the front portion of the glove around the wrist is made of terry cloth and not leather as is the remainder of the front portion 20 of the glove 10.

Attached to the wrist portion 50 of the glove is a wrist support 52 which is made of a strong elastic material. This wrist support 52 is wrapped around the terry cloth wrist portion 50 of the glove 10. The wrist support 52 is held in place around the wrist portion 50 by a Velcro fastener 54. One portion of the Velcro fastener **54*a* is attached on one side of the free end 56 of the wrist support band 52 and the other portion of the Velcro fastener 54*b* is attached on the opposite side of the wrist support band 52 at the portion 58 of the wrist support band 52 closest to the point where it is attached to the terry cloth wrist portion 50 of the glove. Although this wrist support 52 has been described as being attached to the rear of the glove 10, this wrist support 52 can be attached to any portion of the wrist portion 50 of the glove 10**.

In addition to the leather and terry cloth portions of the glove, it is preferred that a very smooth, elastic material be included along the inside portion 42 of the fingers between the leather front and the terry cloth rear portions of the fingers of the glove. This elastic material provides additional flexibility for free movement of the fingers without danger of ripping the leather or the terry cloth from excess bending of the fingers. Furthermore, since this material has a smooth, silky finish, the fingers of the glove can be more easily moved when in contact with one another. In providing such a smooth, elastic material for the finger portions of the glove 10, it is preferred that the elastic material be of a length shorter, from the finger web to the finger tip, than the rear, terry cloth finger portions and larger than the front, leather finger portions so as to impart a curvature to the fingers of a glove which is similar to the natural curvature of a person's fingers. With the length of the elastic fourchette portion 42 being shorter than the rear, terry cloth finger portions and larger than the front, leather finger portions, the rear finger portions likewise have a longer length than the front finger portions.

The sports glove 10 of the present invention offers a number of features not provided by prior art gloves. First of all, the player wearing a glove while engaged in an athletic activity will often perspire heavily under the glove. As a result, the leather will frequently become wet, thereby leading to rapid deterioration of the glove. The terry cloth portion of the glove of the present invention will soak up the perspiration on the back of the hand as well as providing for a sweat band around the wrist to soak up any perspiration coming from the arm. Furthermore, the terry cloth back portion 40 provides the wearer with an extended sweat band with which to wipe his forehead or face. Another feature of this glove not found in other prior art gloves is that the wrist support 52 is connected to the glove 10 itself. This wrist band will provide support for the wrist of the player, and with the Velcro fastener the player can rest assured that the glove will not come off his hand. In addition, the Velcro fastener 54 allows the strap 14 to be securely inserted between the wrist support 52 and the wrist portion 50 of the glove 10 so as to prevent the racquet 12 from flying out of the player's hand.

A further feature of the sports glove 10 is that the fingers are shaped to be in a curved configuration when it is manufactured. Since this curved configuration is the same as would be the natural configuration of a glove after use, the material comprising both the back and front portions of the fingers are not stretched out of proportion. As a result, this curved finger configuration will add life to the glove.

While the sports glove of the present invention has been described with reference to its preferred embodiments, various modifications and alterations will occur to those skilled in the art from the foregoing detailed description and the accompanying drawing. Furthermore, while the glove of the present invention has been described as having a leather front portion and a terry cloth rear portion, the front portion can also be made out of any leather-like, inelastic, tough material, and the rear portion can be made of any pliable, perspiration-absorbing material. These and other modifications and variations are intended to fall within the scope of the appended claims.

What is claimed is:

1. A sports glove for use in a game which requires a player to securely grip some type of racquet or club handle, said glove having four finger portions and a thumb portion comprising a handle-gripping front portion covering the fingers and palm of the player comprised of one continuous piece of substantially inextensible material, said handle-gripping surface extending from the front of the player's fingertips to the bottom of the player's palm;

a back portion which extends from the back of the tip of player's fingertips to the base of the player's wrist, said back portion being comprised of a terry cloth material for absorbing perspiration;

a wrist portion which extends over the wrist of the player and which is integral with the back portion, said wrist portion extending entirely around the player's wrist and connecting to said front portion of the glove, said wrist portion also being comprised of a terry cloth material for absorbing perspiration;

a wrist support band which extends completely over said wrist portion and having a first end being attached to said wrist portion of the glove, said wrist support band being of an elastically extensible material and having a first fastener element secured to one side of the first end thereof and a mating fastener element secured on an opposite side of a second end of said wrist support band.

2. The sports glove of claim 1 wherein at least one reinforcing patch of a substantially inextensible material is mounted only at a position of greater than normal wear on the handle-gripping front portion of the glove, whereby said patches of substantially inextensible material prevent uneven wear of the glove.

3. The sports glove of claim 2 wherein said at least one reinforcing patch is small in comparison to said front portion of substantially inextensible material.

4. The sport glove of claim 3 wherein a reinforcing patch is mounted on a portion of the glove overlying the player's palm.

5. The sports glove of claim 3 wherein a reinforcing patch is mounted on a portion of the glove overlying the player's index finger.

6. The sports glove of claim 3 wherein a reinforcing patch is mounted on a portion of the glove overlying the player's thumb.

7. The sports glove of claim 1 wherein a strip of smooth, stretchable material is connected between the front portion of each of the fingers of the glove and a corresponding back portions of each of the fingers of the glove.

8. The sports glove of claim 7 wherein each said strip of smooth, stretchable material is of a length shorter than said corresponding back finger portion of the glove and of a length longer than a corresponding front finger portion of the glove so as to cause the fingers of the glove to curve over said front portion of the glove.

* * * * *